United States Patent [19]

Van Dam et al.

[11] 4,043,859

[45] Aug. 23, 1977

[54] LABEL APPLYING MACHINE

[75] Inventors: John F. Van Dam, Westmont; Jaroslaw Pacholok, Downers Grove, both of Ill.

[73] Assignee: Bell & Howell Company, Chicago, Ill.

[21] Appl. No.: 563,750

[22] Filed: Mar. 31, 1975

[51] Int. Cl.[2] ..... B65C 9/06

[52] U.S. Cl. ..... 156/566; 156/570; 156/DIG.2; 198/688

[58] Field of Search ..... 156/364, 384, 442.2, 156/442.4, 538, 539, 556, 564, 566, 569, 570, 573, DIG. 2, DIG. 25, 511; 198/131, 198, 34, 53 R, 56

[56] References Cited

U.S. PATENT DOCUMENTS

| | | | |
|---|---|---|---|
| 1,495,408 | 5/1924 | Foster | 156/DIG. 2 |
| 1,611,785 | 12/1926 | Schwenk | 156/570 |
| 2,606,681 | 8/1952 | Ridenour | 156/DIG. 2 |
| 2,736,448 | 2/1956 | Winn | 156/DIG. 2 |
| 2,864,522 | 12/1958 | Tuthill | 156/566 |
| 3,005,744 | 10/1961 | McFarlane | 156/570 |
| 3,559,796 | 2/1971 | Marks et al. | 198/198 |

*Primary Examiner*—Caleb Weston
*Attorney, Agent, or Firm*—Robert A. Walsh

[57] ABSTRACT

A labeling machine particularly adapted for use in applying address labels to envelopes and similar mailing pieces which is characterized by a magazine for accommodating an upright stack of envelopes, with a bottom shuttle plate for feeding successive bottommost envelopes to pinch rolls which deliver the envelopes to a transport system which includes a horizontally disposed, lug-type transport conveyor which advances the envelopes to a label applying head, the latter being operable to feed address labels from a supply source and to apply the same to the desired spot on each successive envelope, with provision for quickly converting the machine for handling envelopes of different length by varying the spacing between the lugs on the conveyor and changing the speed of operation of the shuttle plate and the label applying head.

9 Claims, 9 Drawing Figures

LABEL APPLYING MACHINE

This invention relates to label applying systems and machines and is more particularly concerned with improvements in a system and a machine of a type which has been employed for applying address labels to mailing pieces, such as, cards, envelopes, fliers or similar work pieces, wherein the machine is constructed so as to permit conversion for operation on work pieces of more than one size.

Machines designed for operation at relatively high speed have heretofore been developed for applying address labels to mailing pieces or the like. One from of such machines, which has been available commercially, comprises a supply hopper for the mailing pieces, which may be cards, envelopes, magazines, or pieces of a similar nature, with the hopper having a reciprocating shuttle plate operative to deliver the mailing pieces from the bottom of a stack to a transport system for advance to a label applying area where a label head separates strips of labels from supply sheets, and separates the individual labels from the strips so as to feed them one-by-one through a glue applying mechanism and onto successive work pieces as the latter are advanced by the transport system to the label applying area. In such machines, as heretofore supplied, either no provision has been made for adapting the machine to the handling of envelopes or other work pieces which are of more than one size or the convertibility features have not been entirely satisfactory from the standpoint of ease in accomplishing the change from one size to another or the time required for accomplishing a changeover. Where provision has been made for adjusting the machine to accommodate a different size envelope, or the like, it has been found that the changeover time is too long with the output of the machine being reduced to a level generally considered less than desirable. It is a general object of the invention, therefore, to provide in a label applying machine of the type described improvements in the form of mechanism for quickly converting the machine for efficient operation in the handling of mailing pieces of predetermined size to the handling of like mailing pieces of a different size.

A more specific object of the invention is to provide an improved labeling machine, which is particularly adapted for applying labels to mailing pieces, wherein the machine includes a supply hopper for a stack of the mailing pieces, such as, envelopes or other work pieces, with a shuttle-type bottom feed plate for delivering the work pieces one-by-one from the bottom of the supply stack to a conveyor transport mechanism which advances the work pieces to a label applying area at which there is a label supply hopper with associated mechanism operable to feed labels through an adhesive applicator and position them on the work pieces as they are advanced into the label applying area and wherein the several mechanisms are constructed to normally handle work pieces of predetermined size with provision for effecting a relatively easy and rapid conversion to the handling of work pieces of a different size, for example, twice the size or length of the work pieces normally handled.

A still more specific object of the invention is to provide an improved label applying machine of a type which is particularly useful in applying address labels to mailing envelopes, or the like, wherein a supply of envelopes, in the form of a stack is supported in an upright magazine having a reciprocating shuttle plate feed mechanism in the bottom which feeds the bottommost envelopes, one-by-one, to a transport mechanism including a lug carrying endless conveyor which advances the envelopes to a label applying area where an overhead label supplying and feeding mechanism advances sheets of labels to a separator device which feeds individual labels through an adhesive applicator and applies the labels in the desired position on the successive envelopes and wherein the transport conveyor is adapted to be adjusted to accommodate envelopes of a different size or length while the drives for the envelope feed mechanism and the label feeding and applying mechanism are adjustable so as to enable the feed of the envelopes and the feed of the labels to be properly timed relative to the movement of the conveyor for applying the address label in the desired spot on each envelope.

These and other objects and advantages will be apparent from a consideration of the address label applying machine which is shown by way of illustration in the accompanying drawings wherein.

Figure 1:
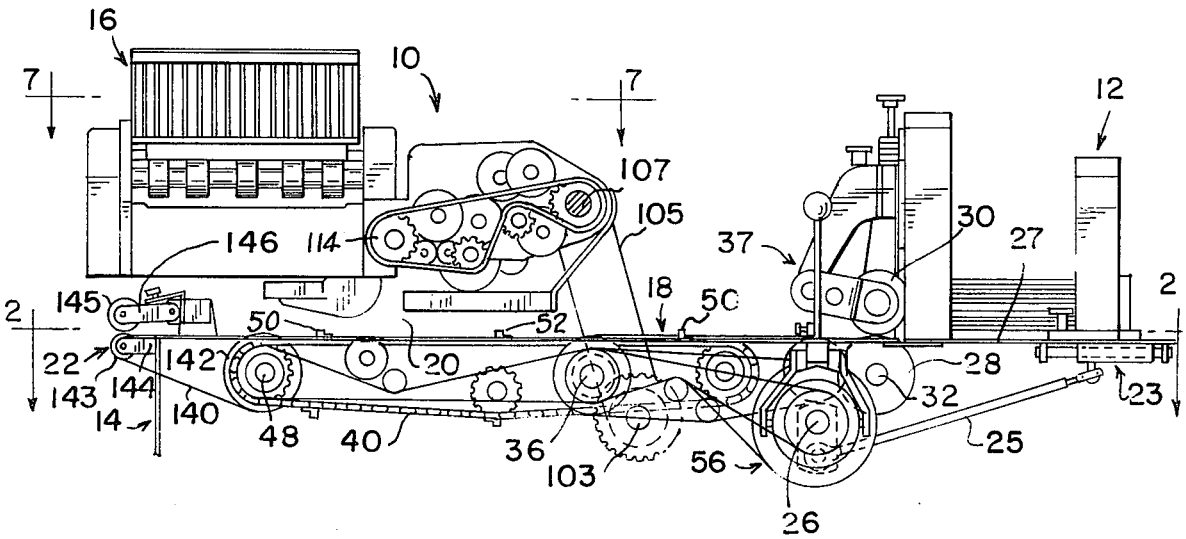
FIG. 1 is a side elevation of an address label applying machine which incorporates apparatus embodying the principles of the invention, the view omitting some elements not necessary for an understanding of the present invention.

Referring first to FIG. 1, there is illustrated a label applying mechanism or machine 10 for affixing address labels to mailing envelopes which incorporates the principal features of the invention, the machine being adapted to handle envelopes of one standard size and being readily convertible to the handling of envelopes of a standard size which is twice the length normally handled by the machine.

The machine 10 comprises a hopper 12 at one end of a supporting frame structure 14, a label feeding and applying head 16 at the opposite end of the frame structure 14 and a connecting transport system 18 extending from the hopper 12 to a label applying area 20 beneath the label head unit 16 and beyond the label applying area 20 to a discharge or delivery mechanism 22.

The hopper 12 is adapted to receive a stack of the envelopes, or other work pieces, and is adjustable to accommodate, for example, standard size envelopes of 10 inch length or standard size envelopes of 20 inch length, the envelopes being positioned in the hopper for feeding from the bottom of the stack in the lengthwise direction. A bottom reciprocating shuttle plate type feed mechanism is indicated at 23. The shuttle plate is reciprocated by a crank arm 25 on a shuttle plate drive shaft 26 extending transversely of the support frame 14 and journaled in suitable bearing members beneath the table forming top plate structure 27. The envelopes are advanced, one-by-one, by the shuttle feed mechanism 23, to pairs of co-operating top and bottom pinch rolls 30 and 28. The lowermost pinch rolls 28 are carried on a cross shaft 32 which is journaled beneath the top plate 27 and carries a pulley 33 which is driven by belt 34 running from a pulley 35 on a cross shaft 36 which constitutes the main drive shaft for the machine and which is suitably journaled beneath the top plate 27. The topmost pinch rolls 30 are carried on a frame structure indicated at 37 with appropriate means for adjusting the pressure of the rolls 30 on the rolls 28. The pinch rolls 28, 30 advance the envelopes to a traveling belt assembly constituting part of the transport system.

Figures 3, 4, 5, 6:
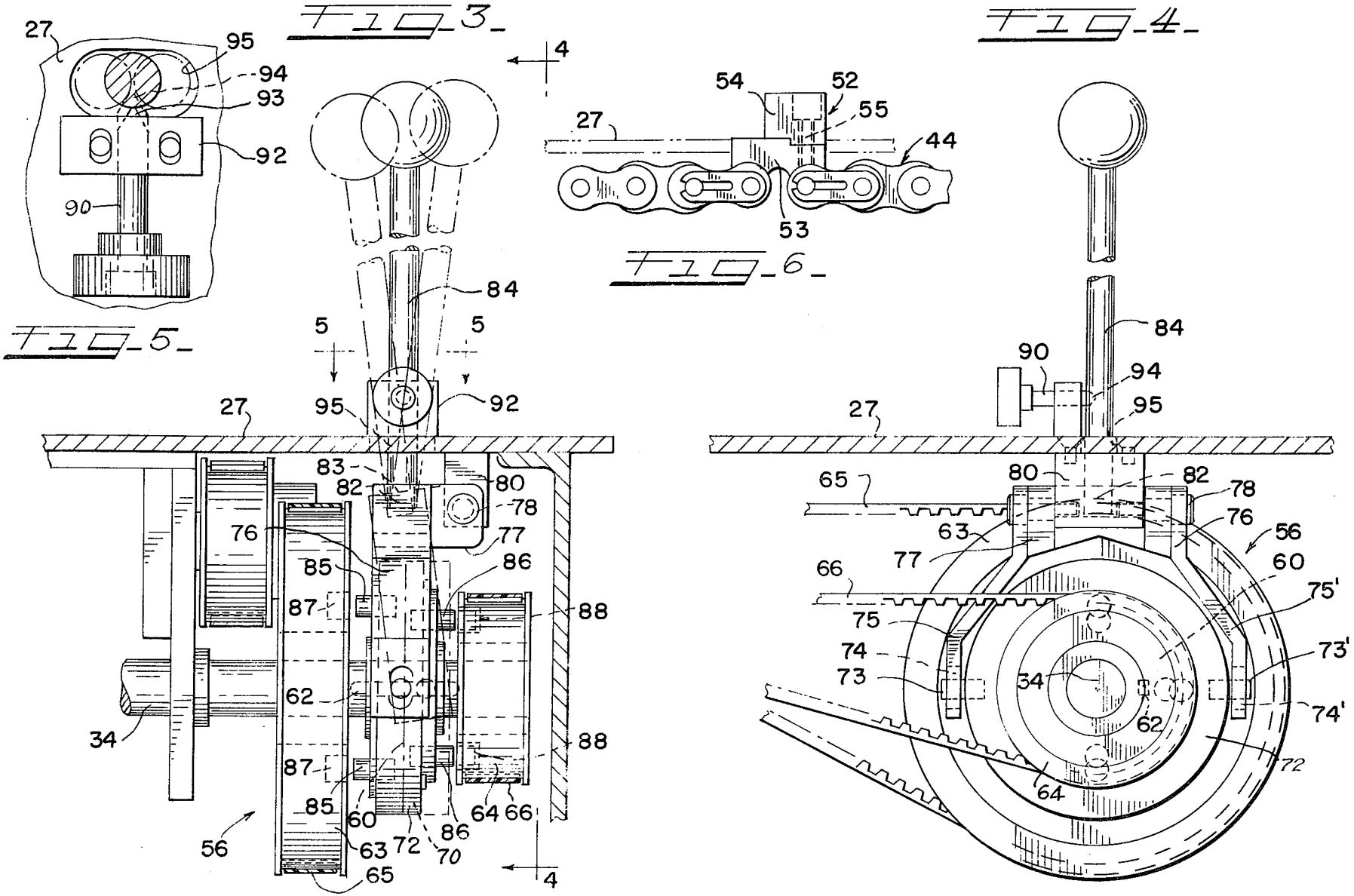
FIG. 3 is a vertical sectional view taken on the line 3—3 of FIG. 2, to a larger scale.
FIG. 4 is a sectional view taken on the line 4—4 of FIG. 3.
FIG. 5 is a fragmentary sectional view taken on the line 5—5 of FIG. 3.
FIG. 6 is a fragmentary sectional view taken on the line 6—6 of FIG. 2, to a larger scale.

The traveling belt assembly which receives the envelopes from the pinch rolls 28 and 30 comprises three transversely spaced belt members 38 which have their top runs spaced slightly above the top plate 27 and advance the envelopes from the pinch rolls 28 and 30 to a pair of lug chains 40 and 40'. The belts 38 are carried at one end on pulleys 42 on the main drive shaft 36 and at the other end on pulleys 43 on an idler shaft 44 which is journaled beneath the top plate 27. The envelopes are advanced by the belts 38 onto the transversely spaced, lug carrying chains 40 and 40'which co-operate in advancing the envelopes to a label applying area. The chains 40 and 40' are supported at one end on sprockets 45, 45' carried on an idler shaft 46 which is journaled beneath the top plate 27. The chains 40 and 40' are supported on the other ends thereof on sprockets 47, 47' mounted on a driven cross shaft 48 which is journaled in suitable bearing members arranged beneath the top plate 27. The chains 40 and 40' travel in parallel, vertical planes and have mounted thereon spaced envelope engaging pusher lugs 50, 52 and 50', 52' which are arranged on the chains in transversely aligned and paired relation and extend outboard of the chain path. The chains 40 and 40' are mounted with the top runs in openings in the top plate 27 so that the lugs 50, 52 and 50', 52' project above the same while they are advanced along the top run so that the trailing ends of the envelopes are engaged by pairs of the lugs 50, 50' or 52, 52' when the machine is handling the shorter length envelopes. The lugs 50 and 50' are fixed on the chains 40 and 40' with base portions forming chain links while the alternate lugs 52 and 52' are removably mounted on the chains. As shown in FIG. 6, the lug 52 is in two parts comprising a base member or portion 53 which forms a link in the chain 40 and a lug forming portion 54 which is mounted on the base portion 53 by means of a threaded bolt member 55 which enables ready removability of the lug forming portion 54 so as to double the space between the lugs 50 on the chain. The lugs 50'and 52' on the chain 40' are mounted in a similar manner and the chain is mounted relative to the chain 40 so as to transversely align the lugs 50' and 52' with corresponding lugs 50 and 52 on the chain 40 enabling the chains 40 and 40' to be converted to the handling of the smaller or the larger envelopes, as desired, with the chain speed remaining unchanged.

In order to convert the machine for the handling of a different size envelope, the feed of the envelopes from the hopper 12 and the operation of the labeling head 16 must be increased or decreased, so as to be properly timed relative to the speed of the transport system 18. When handling the smaller sized envelopes, for example, ten inch envelopes, the chains 40 and 40' are provided with the lugs 50, 52 and 50', 52' and the drive for the envelope feed and the label head is at a predetermined rate for proper affixing of the labels on the successive envelopes advanced by the transport system 18 to the label applying area 20. When the machine is converted to the handling of the larger size envelopes, that is, the twenty inch envelopes, the lugs 52, 52' are removed from the chains 40 and 40' and the speed of operation of the shuttle plate 23 and the label head 16 is changed to provide the proper timing of the envelope delivery to the transport system 18 and the proper timing for the label feeding and applying operations of the label head 16. The change in the timing of these two mechanisms is accomplished by operation of a clutch assembly 56, shown particularly in FIGS. 3 to 5, and adjustment of a manually shiftable gear arrangement 51 shown in FIGS. 7 to 9, each constituting part of the drive means for the respective mechanism.

The clutch assembly 56, in the drive means for operating the shuttle plate assembly 23, as shown in FIGS. 3 to 6, comprises a circular plate or disc 60 which is mounted on the shaft 34 for non-rotating and axial sliding movement between a neutral position, and two operating positions, by means of an axially extending, elongate key 62 and two co-operating belt supporting pulleys 63 and 64. The pulleys 63 and 64 are of different diameters and are bearing mounted for free rotation on the shaft 34 on opposite sides of the disc member 60. The pulleys 63 and 64 are connected by cogged timing belts 65 and 66 to pulleys 67 and 68, respectively, which are of like diameter and which are mounted on the main drive shaft 36, so that, the shaft 34 is driven by the connection with the shaft 36 when either of the pulleys 63 or 64 is connected to the shaft 34 by operation of the clutch plate member 60. The clutch plate member 60 has a peripheral edge groove 70 in which a collar 72 is received, the relative dimensions being such as to permit rotation of the disc member 60 within the collar 72. The collar 72 carries two radially directed pins 73, 73' on its periphery which seat in elongate apertures 74, 74' in the legs 75, 75' of a yoke member 76 depending from bifurcated pivot arm 77 which is pivotally mounted by means of pin 78 on a bracket forming mounting block 80 depending from the top frame plate 27. The pivot arm 77 has an upwardly opening, threaded socket formation 82 for receiving the threaded bottom end 83 of an upstanding handle forming stick member 84 which is confined for limited swinging movement in the vertical plane of the axis of the shaft 34 so as to pivot the yoke on the pin 78 between a neutral, vertical position and the operative positions on either side thereof. The shaft driving disc 60 carries on its opposite faces a set of annularly spaced pins 85 and 86 which are adapted to seat in the co-operating sockets 87 and 88 in the faces of the drive pulleys 63 and 64 which confront the opposite faces of the disc 60. The sets of pins 85 and 86 are disengaged in the neutral position of the disc 60. The pins 85 are engaged in the sockets 87 when the clutch handle is swung to the right as shown in FIG. 3 so as to drive the shaft 34 through the larger diameter pulley 63 and the belt 65 when adjusting the machine for handling the larger, twenty inch length, envelopes. To convert to the handling of the smaller, ten inch length, envelopes the handle 84 is swung through the neutral position to the position on the left in FIG. 3 which disengages the pins 85 and engages the pins 86 in the sockets 88 for driving the shaft 34 through the smaller diameter pulley 64 and the belt 66. A position locking screw 90 (FIG. 5) is provided in threaded engagement in a threaded bore in a mounting block 92 which has a pointed end 93 engageable in a co-operating socket 94 in the handle member 84 or projectable into the area above the position limiting guide flot 95 in the top plate 27 for the handle 84 so as to lock the handle in one or the other of its operating positions.

Figure 2:
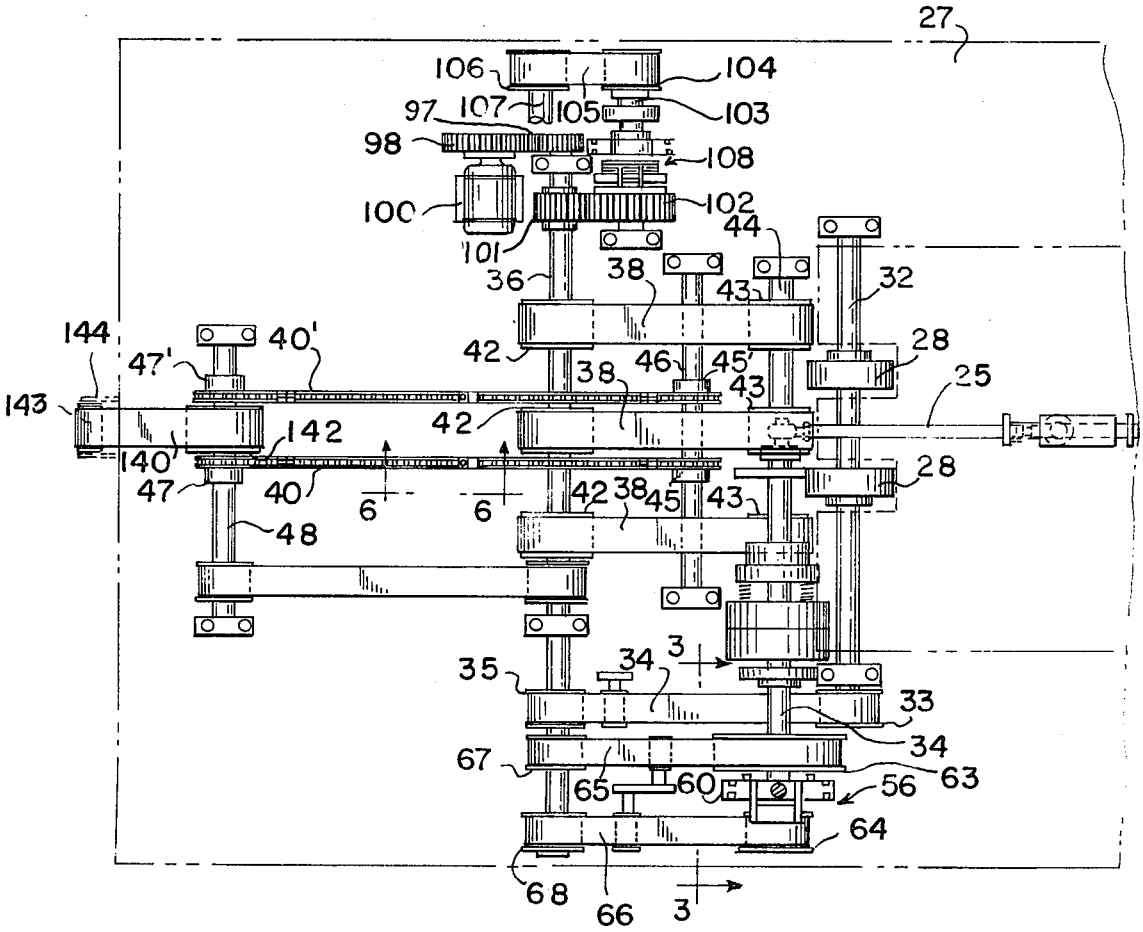
FIG. 2 is a horizontal sectional view, taken on the line 2—2 of FIG. 1, with the top, table forming plate structure removed so as to expose the drive mechanisms.

The main drive shaft 36 is suitably supported beneath the top plate 27 and carries on one end a gear 97 (FIG. 2) which is connected by gear 98 to a drive motor 100 or other power source. A gear 101 on the shaft 36 drives a gear 102 on one end of a short cross shaft 103, which is suitably mounted beneath the top plate 27 and which carries at its other end a pulley 104 which is connected by a cogged timing belt 105 with a pulley 106 on a cross shaft 107. The cross shaft 107, which is supported above the top frame plate 27 and extends across the machine, forms a part of the drive for the several operating elements on the label applying head 16. A safety overload clutch 108 is provided on the shaft 103 to protect the head 16 and manual operation may be provided so as to enable this drive to be disconnected, when desired.

Figure 9:
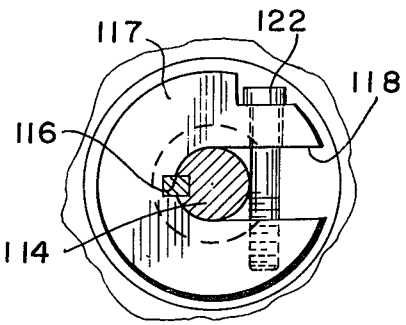
FIG. 9 is a fragmentary cross sectional view taken on line 9—9 of FIG. 7.
Figure 7:
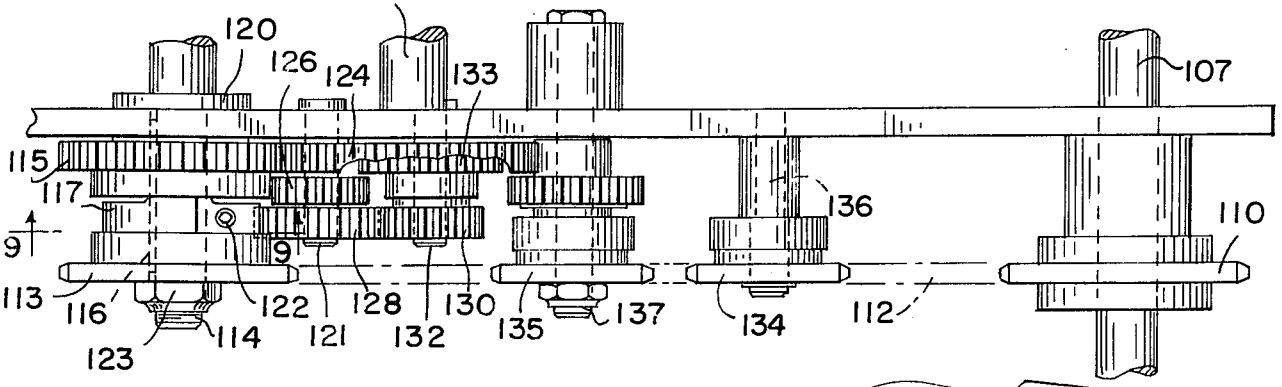
FIG. 7 is a plan view showing portions of the drive mechanism for the label feeding and applying head, the view being taken on the line 7—7 of FIG. 1, to a larger scale and portions being omitted.
Figure 8:
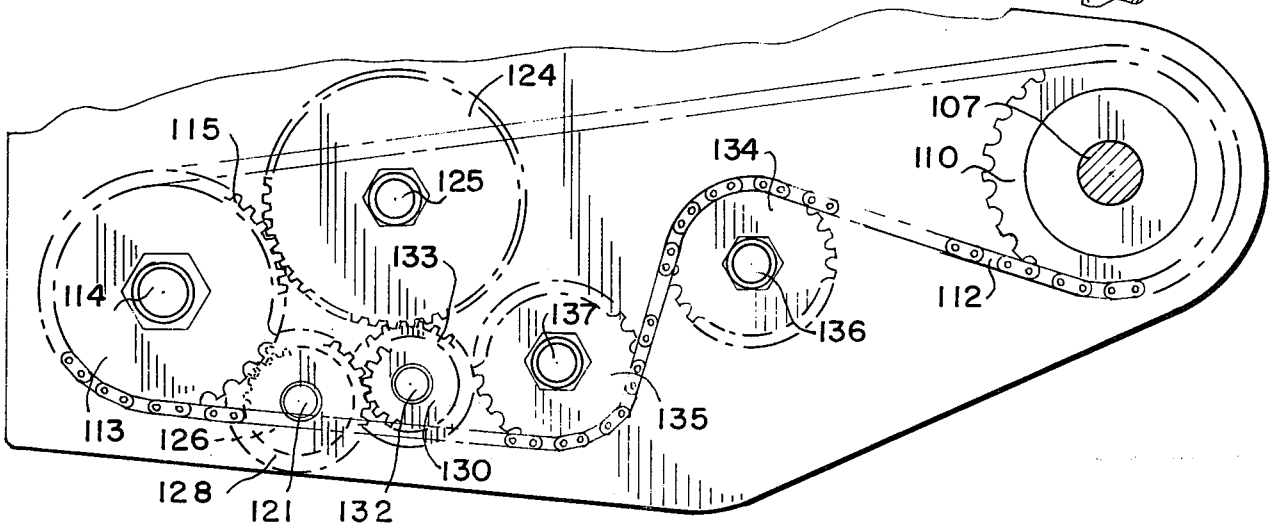
FIG. 8 is an elevational view, largely schematic, showing the drive mechanism of FIG. 7.

The arrangement of the drive for the label feeding and applying head 16, as illustrated in FIGS. 7 to 9, comprises chain and sprocket, and gear connections, between the cross shaft 107 and the various drive elements for the operation of the mechanism in the label applying head 16. The shaft 107 carries a sprocket 110 which is connected by chain 112 with sprocket 113 keyed on the end of cross shaft 114. An axially shiftable gear member 115 is held against rotation on the shaft 114 by the elongate key 116 and against axial shifting by a removable spacer member 117. The spacer member 117 (FIG. 9) is provided with a radial slot 118 which has a width exceeding the diameter of the shaft on which the gear 115 is mounted enabling the spacer to be readily removed from the shaft 114 and replaced thereon. A threaded pin or screw 122 is provided for closing the slot 118 and securing the spacer 117 on the shaft 114. In the arrangement as shown in FIG. 7 the axially shiftable gear 115 is seated against a collar 120 on the shaft 114 and separated by the spacer 117 from the sprocket 113 and the assembly of sprocket 113, spacer 117 and gear 115 is axially retained on the shaft 114 by an end nut 123. This is the position of the gear 115 for driving the head in handling the envelopes of the longer length. In this position the gear 115 engages with and drives gear 124 which is mounted on a cross shaft 125 which constitutes the main drive for the label head unit 16 and governs the rate of speed with which the individual labels are fed to the label applying area. When converting the machine for applying labels to the shorter length envelopes the drive for the head 16 must be changed to deliver the labels at twice the speed since the speed of the transport mechanism is not changed and the shorter envelopes will be advanced into the label applying area 20 twice as fast as the advance of the longer envelopes. In order to change the speed of the mechanisms in the head unit 16 for delivering the labels the spacer 117 is removed from the shaft 114 and the axially shiftable gear 115 is moved out of engagement with the gear 124 on the shaft 125 and into driving engagement with the smaller gear 126 on the stub shaft 127. The stub shaft 127 has keyed thereon a somewhat larger diameter gear 128 which engages in driving relation gear 130 keyed on stub shaft 132. Gear 133 is keyed on the shaft 132 and engages the larger gear 124 on the shaft 125. The gear ratios are selected so as to provide the desired speed for the shaft 125 and obtain proper timing of the delivery of the labels for application of the labels on the desired spot on the smaller envelopes. The chain 112 engages in driving relation with sprockets 134 and 135 on shafts 136 and 137 and these shafts are utilized to drive elements of the label head 16, the speed of which is not required to be changed when the machine is converted from one size envelope to the larger or smaller size.

Upon the application of a label the successive envelopes are advanced to the discharge apparatus 22 (FIG. 1 and 2) which comprises the belt member 140 driven by end support pulley 142 carried on the chain driving cross shaft 48 and supported at the discharge end on pulley 143 rotatably mounted by means of bracket 144 with a co-operating overhead roller 145 mounted on a suitable support structure 146 at the end of the machine.

While the illustrated machine is particularly adapted for addressing of mailing pieces, it may be used for applying labels to other work pieces. Also, the speed of the transport mechanism may be varied without changing the conversion system since all the operating elements are driven from a common power drive source.

I claim:

1. A machine for applying labels to mailing pieces or similar work pieces which machine comprises a supply hopper for receiving an upstanding stack of the work pieces and having a reciprocating feeding mechanism for delivering the work pieces one-by-one from the stack, a transport system including an endless transport conveyor having a horizontally disposed run extending from adjacent said hopper to a label applying area which is spaced from said hopper, said conveyor having lugs spaced thereon for advancing work pieces of a predetermined normal length, alternate lugs on said conveyor being readily removable so as to enable the space between successive lugs to be varied to accommodate work pieces of twice the normal length, and a label applying head unit mounted at said label applying area which includes driven mechanism for feeding successive labels and applying the same in predetermined position on each successive work piece as it is advanced to said label applying area by said lugs, power drive means for operating said transport conveyor at a predetermined speed, a drive connection between said conveyor drive means and said hopper feeding mechanism which includes a clutch having first and second operating positions for selectively changing the speed of operation of said work piece feeding mechanism between first and second speeds according to the speed of advance of the lugs on said transport conveyor whereby to feed the work pieces from the hopper in properly timed relation for delivery to said transport conveyor and a drive connection between said transport conveyor drive means and said label applying head unit which includes means for selectively varying the speed of the label applying mechanism according to the speed of said transport conveyor and the spacing of the lugs on said transport conveyor thereby to time the application of the labels for properly positioning them on the work pieces.

2. A machine for applying labels to mailing pieces or similar work pieces which machine comprises means forming a hopper for receiving a stack of the work pieces and having a reciprocating feeding mechanism for delivering the work pieces one-by-one from the stack, a transport system including a lug bearing transport conveyor having a horizontally disposed top run extending from said feeding mechanism to a label applying area which is spaced therefrom said conveyor having pusher lugs spaced thereon for advancing work pieces of a predetermined length, alternate lugs being mounted on said conveyor for ready removal so as to enable the space between lugs to be doubled to accommodate work pieces of a length greater than said predetermined length, and a label applying head supported at said label applying area which includes mechanism for applying successive labels in predetermined position on each successive work piece as it is advanced to said label applying area by said transport system, power drive means for driving said transport conveyor at a predetermined speed, a drive connection between said conveyor drive means and said feeding mechanism for said work pieces which includes a clutch having first and second operating positions for selectively varying the speed of operation of said feeding mechanism between first and second speeds according to the spacing and speed of advance of the lugs on said transport conveyor so as to feed the work pieces from the hopper in properly timed relation for advance by said transport conveyor and a drive connection between said transport conveyor drive means and said label applying head unit which includes means for selectively varying the speed of the label applying mechanism so as to time the application of the labels relative to the advance of the work pieces for placing them on the work pieces in said predetermined position.

3. A machine as set forth in claim 2 wherein said alternate conveyor lugs comprise a base member forming a portion of said transparent conveyor and a readily detachable member upstanding from said base member which extends outboard of said base member and is adapted to engage the trailing end of a work piece.

4. A machine as set forth in claim 2 wherein said means for selectively varying the speed of said label applying mechanism comprises a driven shaft in said driving connection with said conveyor drive means, a drive shaft in said label applying head and a readily adjustable connecting means between said driven shaft and said drive shaft in said label applying head which enables quick conversion of the driving speed of said shaft in said label applying head so as to time the application of the labels according to the delivery of the work pieces to the label applying area by said transport conveyor.

5. A machine for applying labels to mailing pieces or similar work pieces which machine comprises means forming a hopper for receiving a stack of the work pieces and having a reciprocating feeding mechanism for delivering the work pieces one-by-one from the stack, a transport system including a lug bearing transport conveyor having a horizontally disposed top run extending from said feeding mechanism to a label applying area which is spaced therefrom, said conveyor having pusher lugs spaced thereon for advancing work pieces of a predetermined length, alternate lugs being mounted on said conveyor for ready removal so as to enable the space between lugs to be doubled to accommodate work pieces of a length greater than said predetermined length, and a label applying head supported at said label applying area which includes mechanism for applying successive labels in predetermined position on each successive work piece as it is advanced to said label applying area by said transport system, power drive means for driving said transport conveyor at a predetermined speed, a drive connection between said conveyor drive means and said feeding mechanism for said work pieces which includes a manually operable clutch mechanism in said drive connection between said conveyor drive means and said feeding mechanism for said work pieces for selectively varying the speed of operation of said feeding mechanism according to the spacing and speed of advance of the lugs on said transport conveyor so as to feed the work pieces from the hopper in properly timed relation for advance by said transport conveyor and a drive connection between said transport conveyor drive means and said label applying head unit which includes means for selectively varying the speed of the label applying mechanism so as to time the application of the labels relative to the advance of the work pieces for placing them on the work pieces in said predetermined position.

6. A machine as set forth in claim 5 wherein said clutch mechanism comprises a drive shaft for operating said feeding mechanism, a clutch plate element mounted in axially shiftable, non-rotatable relation on said drive shaft, a pair of plate-like circular drive members rotatably mounted on said drive shaft on opposite sides of said clutch plate element which drive members have a drive connection with said power drive means, said plate-like drive members being of different diameters and having separable connecting means which is engaged in one axially shifted position of said clutch plate element, and manually operable means for axially shifting said clutch plate element between engaged and non-engaged positions with said drive members. unit which includes means for selectively varying the speed of the label applying mechanism so as to time the application of the labels relative to the advance of the work pieces for placing them on the work pieces in said predetermined position.

7. A machine for applying labels to mailing pieces or similar work pieces which machine comprises means forming a hopper for receiving a stack of the work pieces and having a reciprocating feeding mechanism for delivering the work pieces one-by-one from the stack, a transport system including a lug bearing transport conveyor having a horizontally disposed top run extending from said feeding mechanism to a label applying area which is spaced therefrom, said conveyor having pusher lugs spaced thereon for advancing work pieces of a predetermined length, alternate lugs being mounted on said conveyor for ready removal so as to enable the space between lugs to be doubled to accommodate work pieces of a length greater than said predetermined length, and a label applying head supported at said label applying area which includes mechanism for applying successive labels in predetermined position on each successive work piece as it is advanced to said label applying area by said transport system, power drive means for driving said transport conveyor at a predetermined speed, a drive connection between said conveyor drive means and said feeding mechanism for said work pieces which includes means for selectively varying the speed of operation of said feeding mechanism according to the spacing and speed of advance of the lugs on said transport conveyor so as to feed the work pieces from the hopper in properly timed relation for advance by said transport conveyor and a drive connection between said transport conveyor drive means and said label applying head unit which includes means for selectively varying the speed of the label applying mechanism, said means for selectively varying the speed of said label applying mechanism comprising a driven shaft in said driving connection with said conveyor drive means, a drive shaft shaft in said label applying head and a readily adjustable connecting means between said drive shaft in said label applying head which enables quick conversion of the driving speed of said shaft in said label applying head, said readily adjustable connecting means comprising an axially shiftable gear member keyed on said driven shaft and separate gear trains connecting said shiftable gear member with said shaft in said label applying head which drives said shaft in said label applying head at different speeds so as to enable the speed of said label head shaft to be adjusted, upon changing the lug spacing on said transport conveyor, as required to apply the labels in properly timed relation to the delivery of the work pieces to the label applying area by said transport conveyor.

8. A machine for applying labels to mailing pieces or similar work pieces which machine comprises means forming a hopper for receiving a stack of the work pieces and having a reciprocating feeding mechanism for delivering the work pieces one-by-one from the stack, a transport system including a lug bearing transport conveyor having a horizontally disposed top run extending from said feeding mechanism to a label applying area which is spaced therefrom, said conveyor having pusher lugs spaced thereon for advancing work pieces of a predetermined length, alternate lugs being mounted on said conveyor for ready removal so as to enable the space between lugs to be doubled to accommodate work pieces of a length greater than said predetermined length, and a label applying head supported at said label applying area which includes mechanism for applying successive labels in predetermined position on each successive work piece as it is advanced to said label applying area by said transport system, power drive means for driving said transport conveyor at a predetermined speed, a drive connection between said conveyor drive means and said feeding mechanism for said work pieces which includes means for selectively varying the speed of operation of said feeding mechanism according to the spacing and speed of advance of the lugs on said transport conveyor so as to feed the work pieces from the hopper in properly timed relation for advance by said transport conveyor and a drive connection between said transport conveyor drive means and said label applying head unit which includes means for selectively varying the speed of the label applying mechanism so as to time the application of the labels relative to the advance of the work pieces for placing them on the work pieces in said predetermined position, said means for selectively varying the speed of the label applying mechanism comprising a drive shaft in said label applying head, a shaft driven by a connection with said transport conveyor drive means, a drive gear mounted on said driven shaft in axially shiftable relation and held in either of two drive positions by a spacer member which is readily removable and replaceable on said driven shaft and a separate drive train connecting said shiftable drive gear with said drive shaft in each of said drive positions so as to operate said drive shaft at different speeds according to the spacing of the lugs on the transport conveyor and time the application of the labels for proper registry on the work pieces.

9. A machine for applying labels to mailing pieces or similar work pieces which machine comprises means forming a hopper for receiving a stack of the work pieces and having a reciprocating feeding mechanism for delivering the work pieces one-by-one from the stack, a transport system including a lug bearing transport conveyor having a horizontally disposed top run extending from said feeding mechanism to a label applying area which is spaced therefrom, said conveyor having pusher lugs spaced thereon for advancing work pieces of a predetermined length, alternate lugs being mounted on said conveyor for ready removal so as to enable the space between lugs to be doubled to accommodate work pieces of a length greater than said predetermined length, and a label applying head supported at said label applying area which includes mechanism for applying successive labels in predetermined position on each successive work piece as it is advanced to said label applying area by said transport system, power drive means for driving said transport conveyor at a predetermined speed, a drive connection between said conveyor drive means and said feeding mechanism for said work pieces which includes means for selectively varying the speed of the operation of said feeding mechanism according to the spacing and speed of advance of the lugs on said transport conveyor so as to feed the work pieces from the hopper in properly timed relation for advance by said transport conveyor, said means for selectively varying the speed of operation of said work piece feeding mechanism comprising a driven shaft having a drive connection with said power drive means, a drive shaft for said work piece feeding mechanism and a clutch assembly mounted on said drive shaft, which clutch assembly comprises a clutch plate mounted on said drive shaft for nonrotatable, axialy shiftable movement and clutch members rotatably mounted on said drive shaft on opposite sides of said clutch plate, each of which have a connection with said driven shaft so as to drive said drive shaft at different speeds when connected to said drive shaft by engagement with said clutch plate, and manually operable means for shifting said clutch plate selectively into and out of locked engagement with said clutch members, and a drive connection between said transport conveyor drive means and said label applying head unit which includes means for selectively varying the speed of the label applying mechanism so as to time the application of the labels relative to the advance of the work pieces for placing them on the work pieces in said predetermined position.

* * * * *